US006502873B1

(12) United States Patent
Horseman

(10) Patent No.: US 6,502,873 B1
(45) Date of Patent: Jan. 7, 2003

(54) RETROFIT DOOR LATCH ATTACHMENT

(76) Inventor: John Horseman, #16, 17409 - 95th Street, Edmonton, Alberta (CA), T5Z 2B1

( * ) Notice: Subject to any disclaimer, the term of this patent is extended or adjusted under 35 U.S.C. 154(b) by 0 days.

(21) Appl. No.: 09/990,382

(22) Filed: Nov. 23, 2001

(51) Int. Cl.[7] ..... E05B 3/00
(52) U.S. Cl. ..... 292/336.3; 292/1; 16/422
(58) Field of Search ..... 292/336.3, 1, 347, 292/348, 350, DIG. 12; 403/120, 121, 133; 16/410, 422, 427, 430

(56) References Cited

U.S. PATENT DOCUMENTS

| | | | | |
|---|---|---|---|---|
| 3,317,231 A | | 5/1967 | Lindquist et al. | |
| 4,006,927 A | | 2/1977 | Recupero | |
| 4,186,855 A | * | 2/1980 | Edman | 222/321 |
| 5,265,307 A | * | 11/1993 | Hull | 16/114 R |
| 5,519,923 A | * | 5/1996 | Rojdev | 27/1 |
| 5,641,102 A | * | 6/1997 | Hellweg | 224/198 |
| 5,713,614 A | | 2/1998 | Anderson | |
| 5,769,145 A | | 6/1998 | Kwatonowski | |

FOREIGN PATENT DOCUMENTS

JP 2002-17581 A * 1/2002 ..... A47J/45/07

* cited by examiner

*Primary Examiner*—Gary Estremsky
(74) *Attorney, Agent, or Firm*—Sean W. Goodwin

(57) ABSTRACT

A retrofit door latch attachment comprises a lever mounted pivotally to the convex surface of the hand grip of a push-button door latch. The lever has a first upper end aligned with push button actuator and a second lower end for ready access by children and the disabled. The lever does not impede normal use of the push button actuator. Preferably, a countersunk fastener is placed through aligned holes formed through both the lever and grip. More preferably, a recess or cup is formed in the first end of the lever for limiting relative side-to-side movement of the lever and actuator. A flexible boot, preferably added to the lever's upper end, envelopes the top of the actuator and excludes moisture-bearing weather and avoids freeze up in cold climates.

8 Claims, 8 Drawing Sheets

1
2
3
4
5
6
7
8
9
9b
10
11
12
13
14
15
16

RETROFIT DOOR LATCH ATTACHMENT

FIELD OF THE INVENTION

The present invention relates generally to a retrofit door latch attachment for a push-button door latch which assists children and handicapped persons in unlatching the door.

BACKGROUND OF THE INVENTION

Screen doors and combination screen and storm doors are commonly installed outside the main doors of homes, and hence swing outwards when opened. The door latches on the outside of such screen and combination doors are typically comprised of a hand pull or grip for fingers and, above the grip, a push-button latch actuator operated by the thumb. When operated, these door latches require first a pushing force from the thumb to engage the actuator and unlatch the door, and then a second pulling force from the fingers on the hand grip to pull the door outwardly and thereby pivoting away from the main door.

It has been found that such latches are often too difficult for children and handicapped persons to operate. This difficulty arises due to the fact that they require the use of both fingers and thumb and that a combination of pushing and pulling forces are needed. These latches are also mounted relatively high on the door adding to the difficulty experienced by children and handicapped persons in wheelchairs.

A number of devices are known to address this problem. For example, in U.S. Pat. No. 3,317,231 to Lindquist et al., an extension door handle is disclosed. Although this device does not interfere with the manual actuation of the door latch in the conventional manner, it does require that the user's hand twist the handle and exert a force laterally of the door in a direction not wholly aiding the opening of the door. Furthermore, this device is comprised of a number of parts, including a rod, a pair of brackets, and numerous screws, washers and cotter pins, all adding to its cost of manufacturing. Another disadvantage is that the handle is located at one level which, although lower and easy to reach for children, may not be at the proper level for disabled persons or older children.

U.S. Pat. No. 4,006,927 to Recupero discloses a door handle attachment where a bracket is mounted to the hand grip and projects outwardly therefrom. A lever is pivotally mounted to the bracket with the handle end extending down below the hand grip. When the lever handle is pulled away from the door it engages the actuator, unlatching the door, and then pulls the door open. One major disadvantage of this device is that it interferes significantly with the manual actuation of the door latch in the conventional manner. The projecting bracket itself, the thickness of the lever and the spacing of the lever a substantial distance from the hand grip, all discourage the normal grabbing of the hand grip with the fingers and actuating the door latch with the thumb in the conventional manner. Thus a device designed to aid children now impedes the relatively taller adults who must then reach down and pull the lever handle which extends downwardly from the bracket.

Ideally a retrofit door latch attachment for a screen door or combination door would be simple in design, inexpensive to manufacture, interfere only minimally with the manual actuation of the door latch in the conventional manner and have a handle which can be gripped across a range of levels.

SUMMARY OF THE INVENTION

The retrofit door latch attachment of the present invention is a first class lever mounted at a pivot and lying tangentially, and in close proximity to, the hand grip of a push-button door latch. The pivot is formed by the interaction of the attachment with a convex surface of the door latch's grip, usually formed as part of the grip. In one embodiment of the invention the lever is mounted to the convex hand grip by means of a countersunk fastener placed through holes formed through both the lever and grip. Other means of mounting the lever to the grip include some form of string flexible wrap such as electrical tape or a Velcro strap.

In other embodiments, include those incorporating a recess or a cup at the upper end of the lever which cups the latch actuator for limiting the amount of side-to-side movement of the lever during operation. Furthermore, the addition of a flexible boot to the upper end of the lever which envelopes the top of the push-button latch assists in limiting the access of inclement, moisture-bearing weather such as snow and ice into the push-button actuator.

DETAILED DESCRIPTION OF THE PREFERRED EMBODIMENTS

Figure 1:
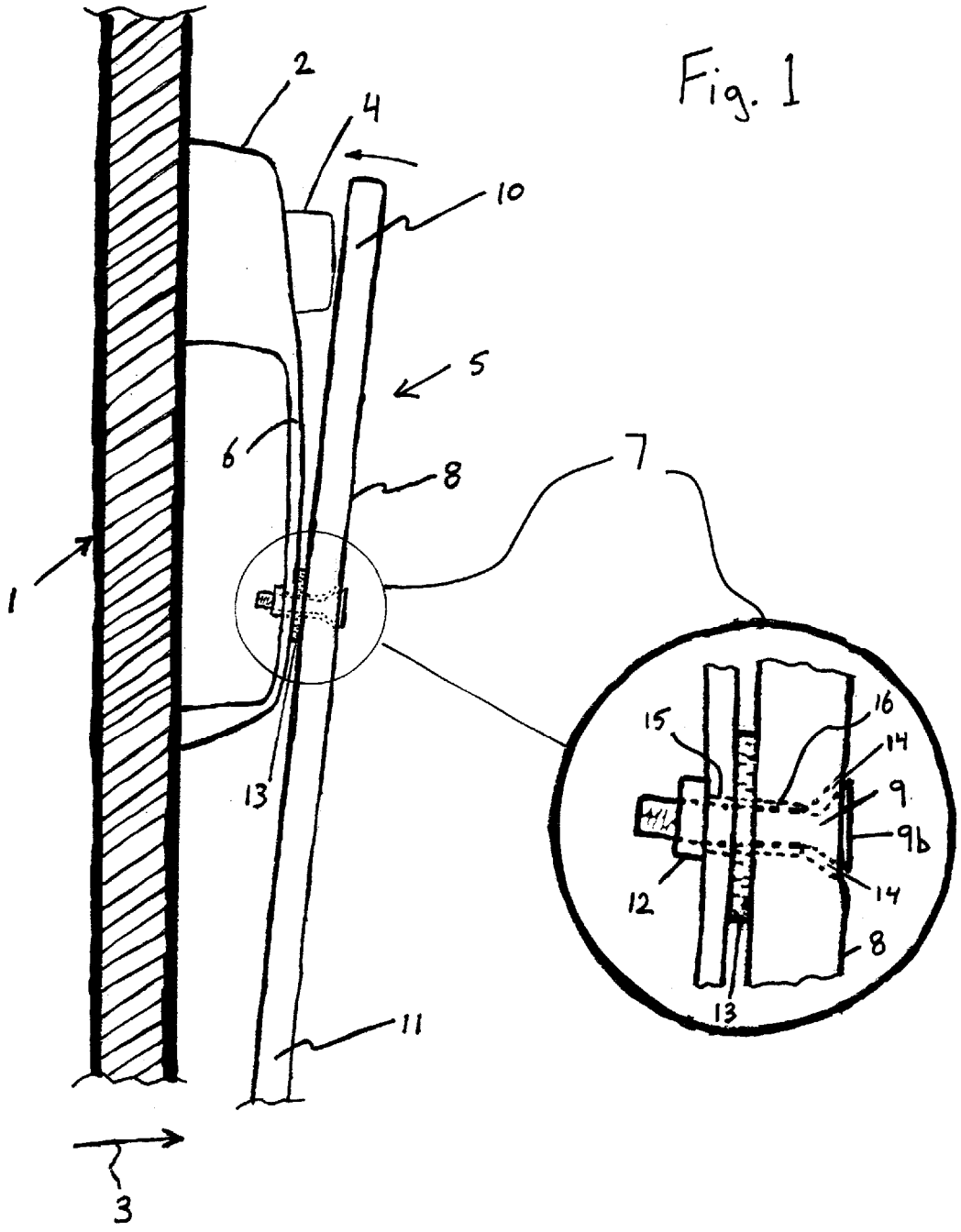
FIG. 1 is a side view of one embodiment of the attachment.
Figure 2A:
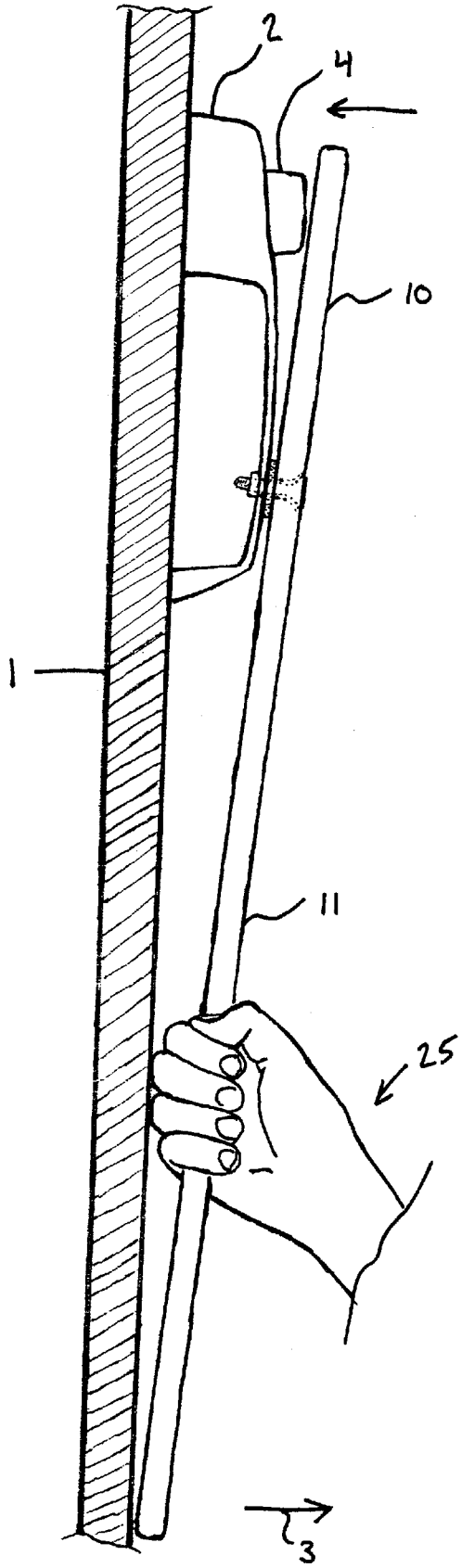
FIG. 2*a* is a side view of the first embodiment of the attachment being grasped along the bottom end by a young child.
Figure 2B:
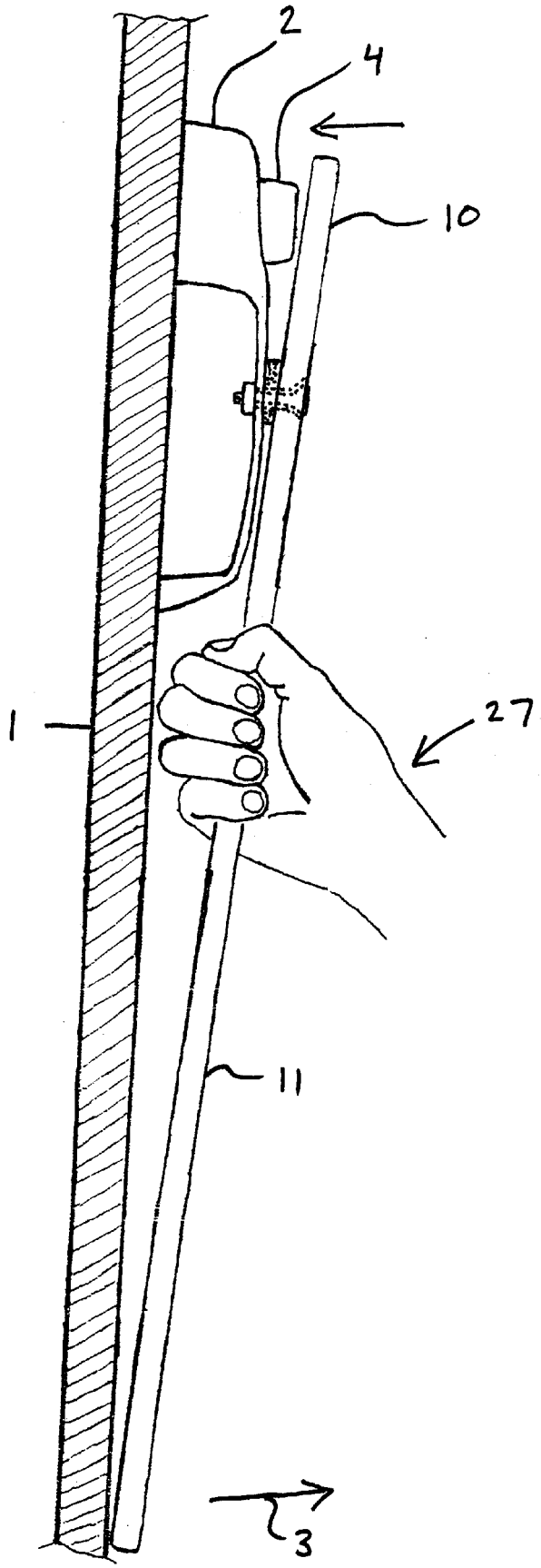
FIG. 2*b* is a side view of the first embodiment of the attachment being grasped in the middle by a disabled person.
Figure 3:
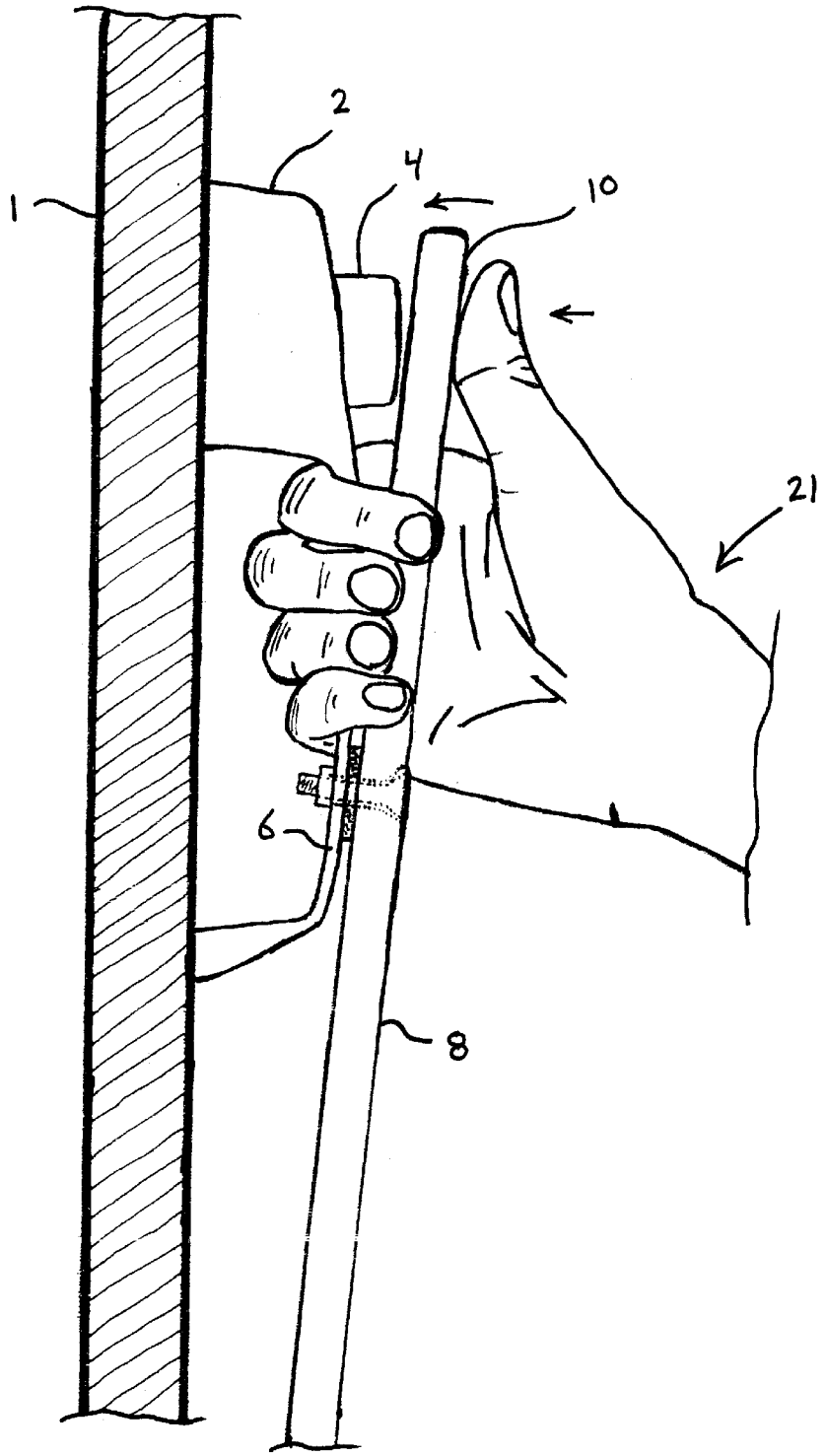
FIG. 3 is a side view of the first embodiment of the attachment being grasped by an adult operating the door latch in the conventional manner.

As shown in FIGS. 1–3 a typical screen or combination door 1 has a push-button door latch 2, such as those manufactured by Wright Products of Rice Lake, Wis., p/n V333. Other types of push-button latches may be secured to the door 1, for example one with a free hanging handle (Wright Products, p/n VF333), but these variations do not impact on the present invention as long as they have a slight convex curve formed on their hand grip, usually formed in the grip as part of the ergonomic design of the handle. The door 1 swings in the direction 3 about a hinge beyond the plane of the drawing. The latch 2, usually of die cast aluminum, includes a push-button latch actuator 4 and a hand grip 6. The latch 2 with its actuator 4 and hand grip 6 are fastened to the door 1.

Having reference to FIG. 1, in a first embodiment, a retrofit door latch attachment 5, essentially a first class lever 8, is pivotally, and tangentially, mounted at pivot 7 on the hand grip 6 such that a first or upper end 10 is opposed to the actuator 4 and a second or lower end 11 extends down below the latch 2 and terminates substantially adjacent the door 1. In this embodiment the lever 8 is constructed of a slender structural member and measures about 24 inches long, ¾ inch wide and a ½ inch thick. The lever 8 can be constructed of a variety of materials and have different dimensions. Further, the lever 8 may be arcuate.

The lever 8 is mounted tangentially to the convex surface of the hand grip 6 through a variety of means, thereby forming the pivot 7. For example, a strong wrap such as electrical tape has been used successfully by the inventor to mount the lever 8 and still keep the necessary amount of movement necessary to allow the lever 8 to pivot and engage the actuator 4. A Velcro strap, or other strong material could also be wrapped about the lever 8 and hand grip 6 to form the pivot 7. In this embodiment the lever 8 is pivotally, and tangentially, mounted to the hand grip 6 through the following easy steps.

A hole 15 is placed, such as by drilling, into or through the hand grip 6. The lever 8 is also provided with a hole 16 such that when the holes 15, 16 are aligned the lever's 8 upper end 10 accurately opposes and is in close proximity to the actuator 4 and the lower end 11 extends down past the latch 2 and preferably rests adjacent the door 1. A fastener 9 is placed through the aligned holes 15, 16. A head 9*b* stops the fastener 9 from passing through the holes 15, 16.

In the embodiment show in FIG. 1 the hole 15 in the latch 2 is at the bottom third of the hand grip 6, whereas the hole 16 in the lever 8 is nearer the upper end 10. Should a different design of push-button latch 2 be secured to the door 1, and if the hole 16 in the lever 8 has been pre-determined, the location of the hole 15 in the hand grip 6 need simply be adjusted to ensure that the upper end 10 of the lever 8 will properly align with the actuator 4 and that the lower end 11 extends downwardly past the latch 2.

The hole in the lever 8 is slightly counter sunk to accept the fastener 9 and retain some surplus space 14 above and below the fastener's head 9*b*. This space 14 permits the lever 8 to easily pivot in the same direction 3 as the opening movement of the door 1 and in the same plane as the plunging motion of the actuator 4.

Once the holes are placed at the appropriate locations, a resilient or rubber washer 13 is inserted between the lever 8 and the hand grip 6. If the grip has a marginally curved or no convex surface at all, the washer can act as the fulcrum or convex surface. The lever 8 is mounted to the hand grip 6 by means of the fastener 9 and a nut 12 threaded at the underside of the grip 6. Depending on the construction of the latch 2, and whether additional strength is need at the hole in the hand grip 6, a metal washer (not shown) can be inserted between the nut 12 and hand grip 6, prior to mounting of the lever 8.

Consequently the upper end 10 of the lever 8 is not only accurately opposed to the actuator 4 but it is also able to pivot in the same common plane as the plunging motion of the actuator 4 because of the surplus space 14 around the head of the fastener 9, the compression qualities of the rubber washer 13, and the fact that it is mounted tangentially to the slight outward convex curve in the hand grip 6. Additionally the pivotal motion of the lower end 11 is in the same direction 3 as the opening movement of the door 1. Thus, the movement of the user's hand (not shown) when pulling the lower end 11 is in a direction most effective for both unlatching and opening the door 1.

Having reference to FIG. 2*a,* a young child 25 can easily grasp the lever 8 at a level along the bottom of the lower end 11 well below the latch 2. By pulling on the lever 8 the same direction 3 as the opening movement of the door 1, the child 25 causes the upper end 10 of the lever 8 to engage the actuator 4 and unlatch the door 1. With and easy and continuous pulling action the child 25 will open the door 1.

As shown in FIG. 2*b,* a disabled person 27, such as a person sitting in a wheelchair, can activate the lever 8 along the lower end 11 and closer to the latch 2 than would the child 25 as shown in FIG. 2*a*. By pulling on the lever 8 the same direction 3 as the opening movement of the door 1, the person 27 causes the upper end 10 of the lever 8 to engage the actuator 4 and unlatch the door 1. Again, continuing with the pulling action the person 27 will open the door 1.

As is shown in FIG. 3, the attachment 8 only interferes minimally with the manual actuation of the door latch 2 in the conventional manner. This is because the lever 8 is relatively thin (only ½ inch in the illustrated embodiment) and is mounted tangentially, and in close proximity, to the latch 2. Accordingly, an adult person 21 can easily grasp around both the hand grip 6 and the lever 8 without any serious discomfort and engage the actuator 4 by pressing with his or her thumb 22 on the upper end 10 of the lever 8. By doing so, the lever 8 will pivot in the same common plane as the plunging motion of the actuator 4, depress the actuator 4 and unlatch the door 1. The person 21 completes the opening process by retaining their grip around both the hand grip 6 and lever 8 and pulling in the same direction 3 as the opening movement of the door 1.

Figure 4:
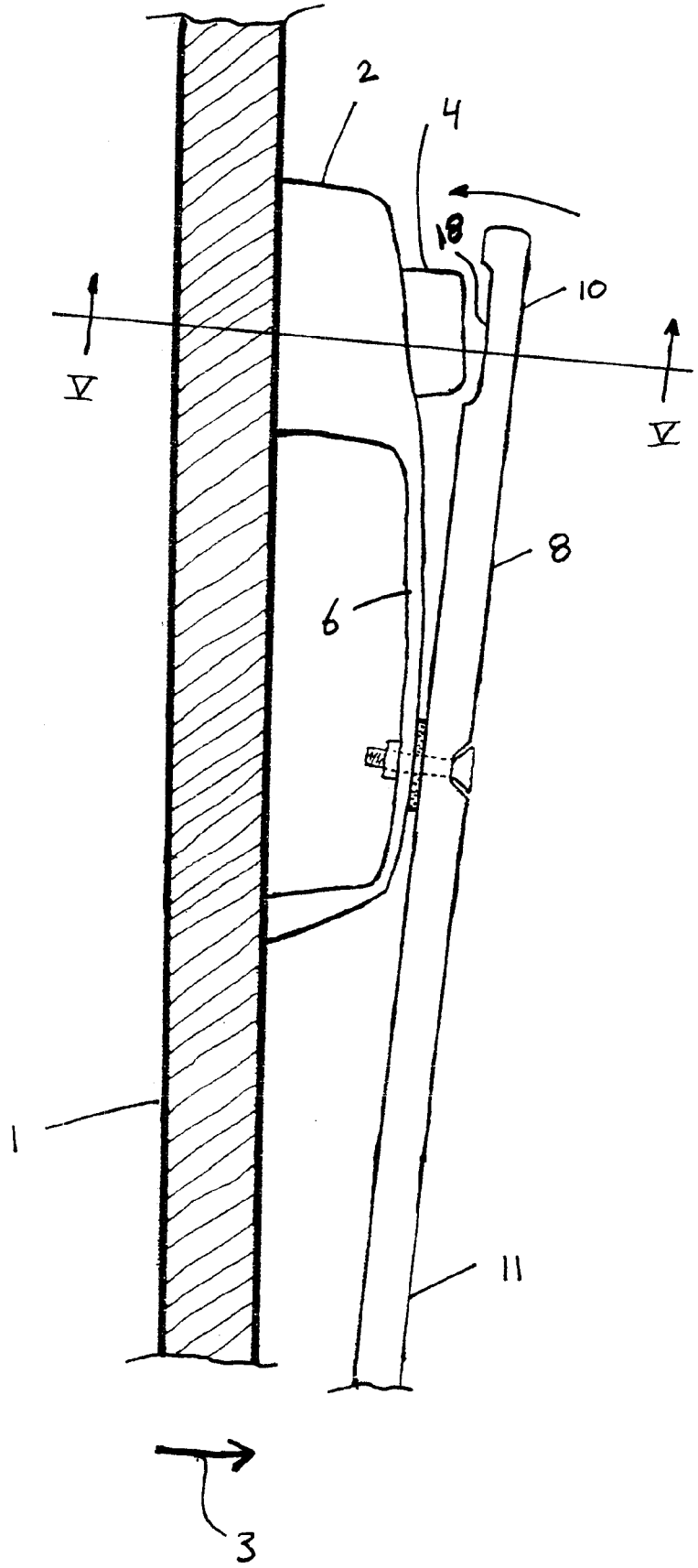
FIG. 4 is a side view of a second embodiment of the attachment.
Figure 5:
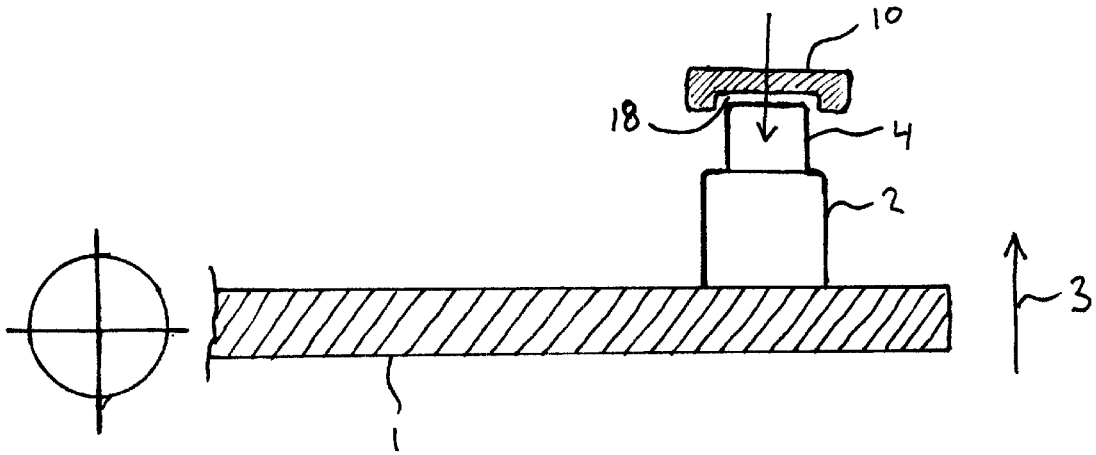
FIG. 5 is a section of line V—V of FIG. 4.

In FIGS. 4 and 5 a second embodiment of the retrofit door latch attachment 5 is shown. The lever 8 is pivotally, and tangentially, mounted at pivot 7 on the hand grip 6 such that its upper end 10 is opposed to the actuator 4 and its lower end 11 extends down past the latch 2 and rests against the door 1. Like the embodiment shown in FIG. 1 the lever 8 of this second embodiment is constructed of a slender structural member.

The lever 8 is mounted to the hand grip 6 through the same steps as described above for the first embodiment shown in FIG. 1. In order to minimize any side-to-side movement of the upper end 10 during operation, a small recess 18 is formed in the upper end 10. The contour of the recess 18 substantially mirrors the contour of the actuator 4 but is slightly larger so as to fit over the actuator 4. When the lower end 11 is pulled and the upper end 10 engages the actuator 4 the recess 18 securely cups the actuator 4 limiting any side-to-side movement of the upper end 10. The depth of the recess 18 in this embodiment is about 1/16 of an inch, but this may vary depending on the material strength of the lever 8.

Figure 6:
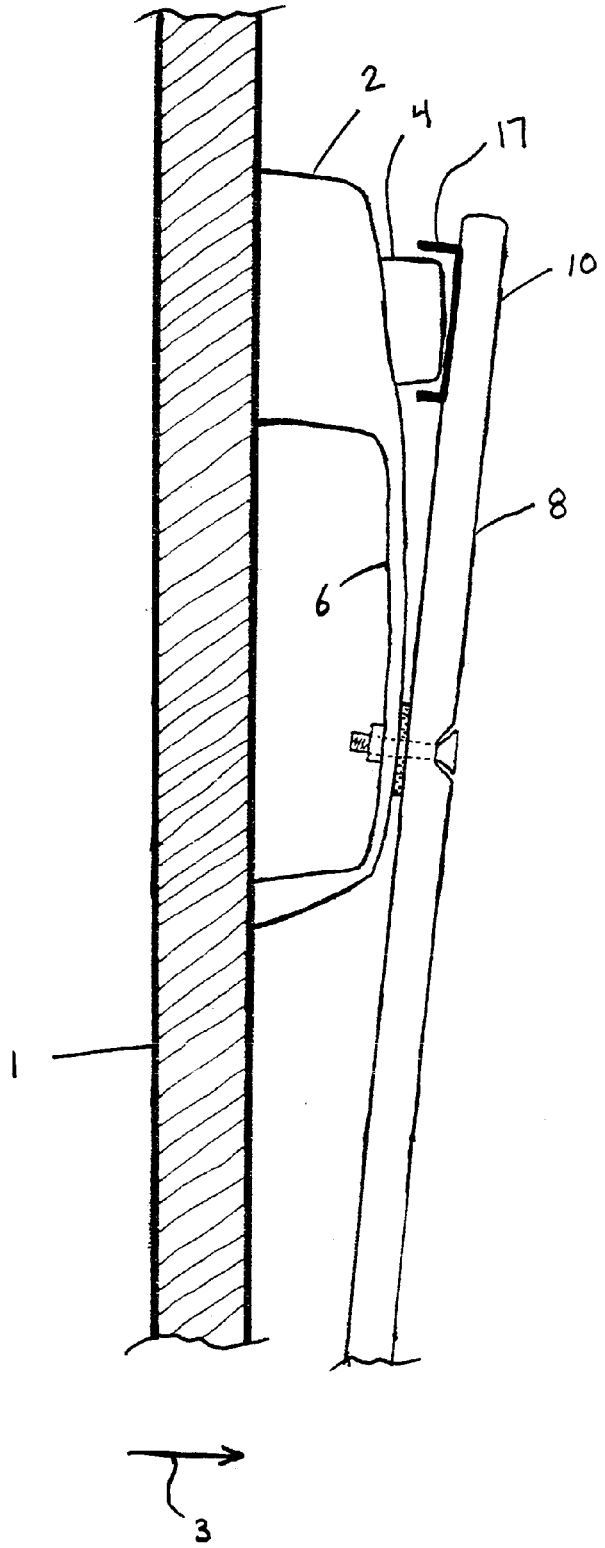
FIG. 6 is a side view of a third embodiment of the attachment.

FIG. 6 shows a third embodiment of a retrofit door latch attachment 5. As before, the lever 8 is pivotally, and tangentially, mounted at pivot 7 on the hand grip 6 such that its upper end 10 is opposed to the actuator 4 and its lower end 11 extends down past the latch 2 and rests against the door 1. The lever 8 is mounted to the hand grip 6 through the same steps as describe above for the first embodiment shown in FIG. 1. In order to minimize any side-to-side movement of the upper end 10, a cup 17 is attached to the upper end 10. The contour of the cup 17 mirrors the contour of the actuator 4 but is slightly larger so as to fit over top of the actuator 4 and functions in the same way as the recess 18 in the second embodiment, shown in FIG. 4, to limit any side-to-side movement of the upper end 10. The cup is made of a hard plastic but other hard materials may be used. The depth of the cup 17 in this embodiment is ¼ of an inch, but this may vary depending on the size of the actuator 4 and the distance it depresses before unlatching the door 1.

Figure 7:
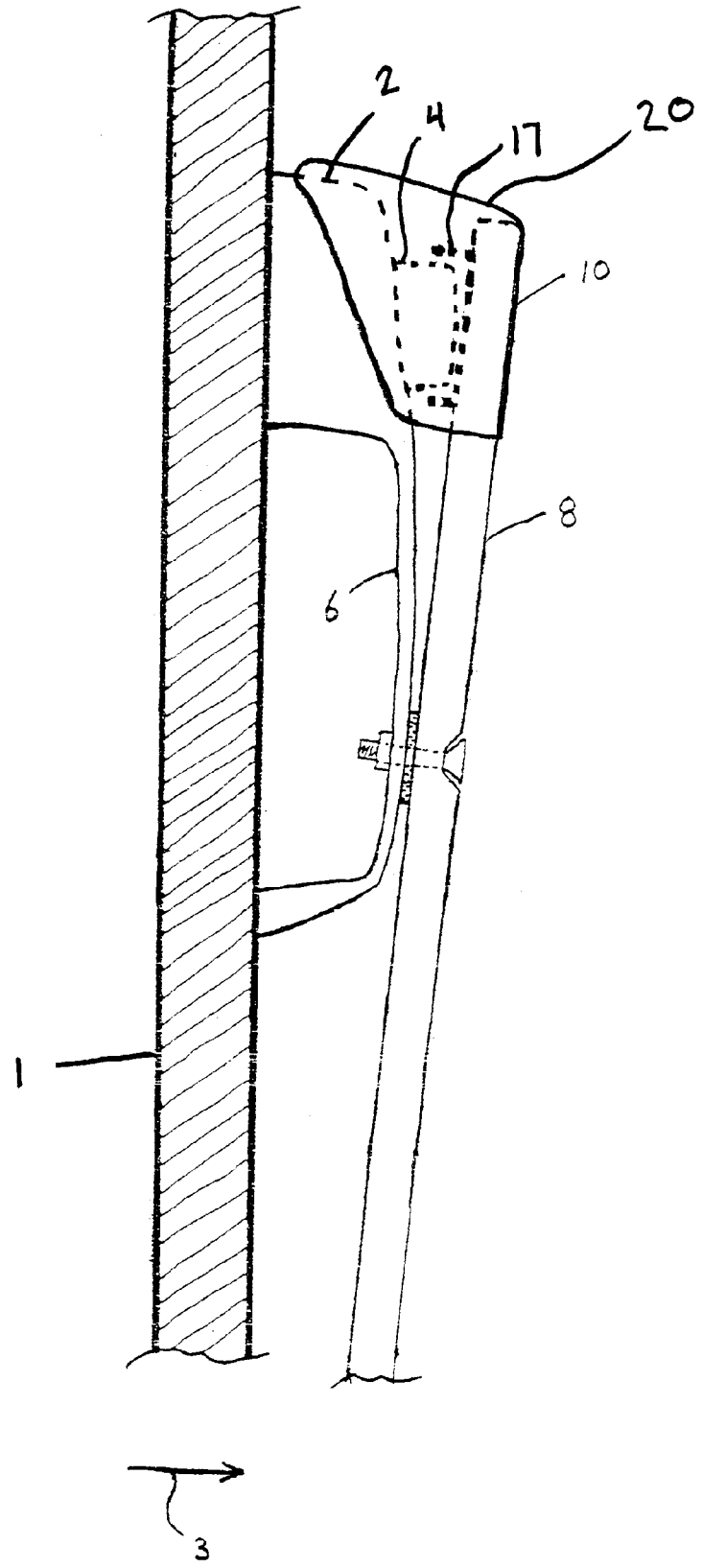
FIG. 7 is a side view of a fourth embodiment of the attachment.

FIG. 7 shows a fourth embodiment of a retrofit door latch attachment 5. The lever 8 is pivotally, and tangentially, mounted at pivot 7 on the hand grip 6 such that its upper end 10 is opposed to the actuator 4 and its lower end 11 extends down past the latch 2 and rests against the door 1. The lever 8 is mounted to the hand grip 6 through the same steps as describe above for the first embodiment shown in FIG. 1.

In order to minimize any side-to-side movement of the upper end 10, a cup 17 is attached to the upper end 10 in the same manner as described for the embodiment in FIG. 6. A flexible boot 20 is added to the upper end 10 such that the boot 20 envelopes the upper end of the latch 2 thereby covering both the actuator 4 and cup 17. The boot 20 keeps adverse weather and moisture, such as snow and ice, from forming around, and inside, the actuator 4.

The embodiments of the invention in which an exclusive property or privilege is being claimed are defined as follows:

1. A retrofit door latch attachment for a push-button door latch having a hand grip having a convex surface comprising:

a lever mounted at a pivot and lying tangentially, and in close proximity to the hand grip of the door latch, the pivot being formed by the interaction of the lever with the convex surface of the grip, the lever having a first end of the lever opposed to the push-button latch actuator, and a second end of the lever extending below the grip, so that pulling on the lever at a point between the pivot and second end pivots the lever about the pivot, engaging the said first end with the push-button latch actuator so as to operate the latch and enable opening of the door.

2. An attachment of claim 1 where the lever is mounted to the convex hand grip by means of a fastener placed through a countersunk hole in the lever which is aligned with a hole in the grip, the fastener and countersunk hole cooperating to act as a pivot.

3. An attachment of claim 2 wherein the fastener is placed through a resilient washer inserted between the lever and grip.

4. An attachment of claim 3 where the said second end extends down to rest substantially adjacent the door.

5. An attachment of claim 4 where the said first end has a slight recess to cup the push-button latch actuator for limiting relative side-to-side movement of the lever and actuator during operation.

6. An attachment of claim 4 where the said first end has a cup attached thereto which fits over the push-button latch actuator for limiting relative side-to-side movement of the lever and actuator during operation.

7. An attachment of claim 6 where the said first end has a flexible boot which fits over the upper end of the push-button door latch, covering the push-button latch actuator, and for excluding adverse weather from the actuator.

8. A retrofit door latch attachment for a push-button door latch having a hand grip comprising:

a washer; and a lever mounted at a pivot and lying tangentially, and in close proximity to the hand grip of the door latch, the washer being sandwiched between the lever and the hand grip, the pivot being formed by the interaction of the lever, the washer and the grip, the lever having a first end of the lever opposed to the push-button latch actuator, and a second end of the lever extending below the grip, so that pulling on the lever at a point between the pivot and second end pivots the lever about the pivot, engaging the said first end with the push-button latch actuator so as to operate the latch and enable opening of the door.

* * * * *